US008353564B2

(12) United States Patent
Kim et al.

(10) Patent No.: US 8,353,564 B2
(45) Date of Patent: Jan. 15, 2013

(54) DOOR ASSEMBLY AND REFRIGERATOR HAVING THE SAME

(75) Inventors: Ung-Su Kim, Gyeongsangnam-Do (KR); Bon-Young Koo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 221 days.

(21) Appl. No.: 12/678,432

(22) PCT Filed: Nov. 12, 2008

(86) PCT No.: PCT/KR2008/006676

§ 371 (c)(1),
(2), (4) Date: Mar. 16, 2010

(87) PCT Pub. No.: WO2009/064117

PCT Pub. Date: May 22, 2009

(65) Prior Publication Data

US 2010/0199710 A1 Aug. 12, 2010

(30) Foreign Application Priority Data

Nov. 15, 2007 (KR) ..... 10-2007-0116864

(51) Int. Cl.
*A47B 96/04* (2006.01)

(52) U.S. Cl. ..... 312/405

(58) Field of Classification Search ..... 312/401, 312/405; 62/449; 49/460
See application file for complete search history.

(56) References Cited

U.S. PATENT DOCUMENTS

| | | | | | |
|---|---|---|---|---|---|
| 3,231,055 | A * | 1/1966 | Leach | 49/460 |
| 3,430,386 | A * | 3/1969 | Schmitt et al. | 49/382 |
| 4,583,796 | A * | 4/1986 | Nakajima et al. | 312/405 |
| 5,358,326 | A * | 10/1994 | Cherry et al. | 312/405 |
| 5,797,164 | A * | 8/1998 | Donaghy | 16/412 |
| 5,975,663 | A * | 11/1999 | Becker | 312/405 |
| 6,375,291 | B1 * | 4/2002 | Nam et al. | 312/405 |
| 6,708,374 | B2 * | 3/2004 | Mandel | 16/436 |
| 2004/0207304 | A1 * | 10/2004 | Cho | 312/405 |
| 2005/0006997 | A1 * | 1/2005 | Yoshioka | 312/405 |
| 2008/0143227 | A1 * | 6/2008 | Kim et al. | 312/405 |

FOREIGN PATENT DOCUMENTS

| | | | |
|---|---|---|---|
| KR | 20-0341555 | Y1 | 2/2004 |
| KR | 10-2004-0082708 | A | 9/2004 |
| KR | 10-2006-0088692 | A | 6/2006 |
| KR | 10-2007-0070066 | * | 7/2007 |

* cited by examiner

*Primary Examiner* — Janet M Wilkens
*Assistant Examiner* — Timothy M Ayres
(74) *Attorney, Agent, or Firm* — Birch, Stewart, Kolasch & Birch, LLP

(57) ABSTRACT

The present invention relates to a door assembly and refrigerator having the same. The door assembly according to the present invention includes a door main body, a panel disposed on a front surface of the door main body, a handle having at least one end coupled to an upper end or a lower end of the door main body, and a cover provided with a handle receiving portion allowing an upper end or a lower end of the handle to be received therein and coupled to the upper end or the lower end of the door main body so as to support the panel. Accordingly, it is capable of replacing the cover without disassembling the handle.

14 Claims, 7 Drawing Sheets

DOOR ASSEMBLY AND REFRIGERATOR HAVING THE SAME

TECHNICAL FIELD

The present invention relates to a door assembly and a refrigerator having the same, and more particularly, to a door assembly which is capable of easily disassembling and assembling components and a refrigerator having the same.

BACKGROUND ART

As well known, a refrigerator includes a refrigerator main body having a cooling chamber, a door for opening and closing the cooling chamber and a refrigerating cycle for supplying cool air to the cooling chamber, and serves to store food items therein in a cool state.

The door of the refrigerator includes an outer case, an inner case disposed in the outer case with a filling space for a foaming agent and caps respectively disposed at upper and lower sides of the outer case and the inner case.

However, since the outer case of the door is implemented as a plate-shaped metallic member coated with paint, it may be easily scratched and/or marked. And, as time elapses, an external appearance may be degraded due to accumulation of the scratches and marks.

Thus, a door assembly configured to prevent the marks and/or scratches by disposing a panel implemented as a transparent stiff member such as a glass member on a front surface of the outer case is currently used so as to solve the above-mentioned problem.

The door assembly includes a door main body, a panel disposed on the front surface of the door main body, an upper cover and a lower cover respectively coupled to an upper end and a lower end of the door main body so as to support the panel, and a handle disposed on the front surface of the door main body.

However, in the door assembly according to the related art, the handle is configured to be coupled to the outside of the upper cover and the lower cover. Thus, the handle should be disassembled first of all when replacing (or, changing) the upper and lower covers, which may take a lot of time and be complicated. Also, in case of replacing the panel, the panel should be disassembled after the handle and the upper cover or the lower cover are disassembled in sequence, and then they should be assembled in reverse sequence, which may require a lot of time and efforts to replace the panel.

DISCLOSURE OF INVENTION

Technical Problem

Therefore, it is an object of the present invention to provide a door assembly which is capable of easily replacing components and a refrigerator having the same.

It is another object of the present invention to provide a door assembly which is capable of reducing the number of screws and a refrigerator having the same.

It is still another object of the present invention to provide a door assembly which is capable of easily replacing a panel and a refrigerator having the same.

Technical Solution

To achieve the object, in accordance with one aspect of the present invention, there is provided a door assembly comprising a door main body, a panel disposed on a front surface of the door main body, a handle having at least one end coupled to an upper end or a lower end of the door main body, and a cover provided with a handle receiving portion allowing an upper end or a lower end of the handle to be received therein and coupled to the upper end or the lower end of the door main body so as to support the panel.

Here, the cover may comprise an upper cover disposed at an upper end of the door main body and a lower cover coupled to a lower end of the door main body.

The handle receiving portion may be formed at the upper cover.

Alternately, the handle receiving portion may be formed at the lower cover.

A handle coupling portion to which the handle is coupled may be formed in the handle receiving portion by being upwardly protruded from the door main body.

The handle and the handle coupling portion may be configured to allow the handle to be inserted from a front side of the door main body.

The handle coupling portion may be provided with female screw portions, and the handle may be provided with a through hole.

The handle and the handle coupling portion may be engaged with each other so as not to be moved back and forth.

The handle may be provided with an engagement portion in a concave shape so that the handle coupling portion can be inserted thereinto.

The handle and the handle coupling portion may be configured to be coupled to each other by screws.

A side cover coupled to at least one side surface portion of the door main body may be further included.

At least one of the upper cover and the lower cover may be provided with a flat surface to come in planar-contact with an upper end or a lower end of the side cover.

A side cover may be further included so as to support the panel by being coupled to at least one side surface portion of the door main body to be able to be disassembled in right and left directions without being restrained by the cover.

The cover may be provided with a boss disposed at a rear surface of the side cover.

The side cover may be provided with a through hole through which a coupling member coupled to the boss can pass therethrough.

A surface of the side cover may be configured to be disposed on the same plane with an end portion of the cover.

The cover may be provided with a stopper for preventing the side cover from forwardly moving.

The handle receiving portion may be formed to be penetrated in upper and lower directions.

In accordance with another aspect of the present invention, there is provided a refrigerator having a door assembly, the refrigerator comprising a refrigerator main body having a cooling chamber therein and the door assembly coupled to the refrigerator main body so as to open and close the cooling chamber.

ADVANTAGEOUS EFFECTS

As aforementioned, according to the present invention, the upper end or the lower end of the handle is coupled to the upper end or the lower end of the door main body without coupling to the upper cover or the lower cover, accordingly it is capable of easily replacing the upper cover or the lower cover without disassembling the handle, thereby being capable of rapidly and easily replacing the panel.

Also, according to the present invention, the end portion of the handle is engaged in back and forth directions, accordingly it is capable of reducing the number of screws, thereby being capable of reducing the number of necessary components and of rapidly and easily disassembling and assembling the handle.

And, according to the present invention, the side cover can be disassembled and assembled to the lateral side of the door main body without restriction of the upper cover or the lower cover, accordingly it is capable of discharging out the panel by disassembling only the side cover without disassembling the upper cover or the lower cover and the handle at the time of replacing of the panel, thereby being capable of rapidly and easily replacing the panel.

MODE FOR THE INVENTION

Hereafter, description will now be given in detail of one embodiment of a door assembly and a refrigerator having the same according to the present invention with accompanying drawings.

Figure 1:
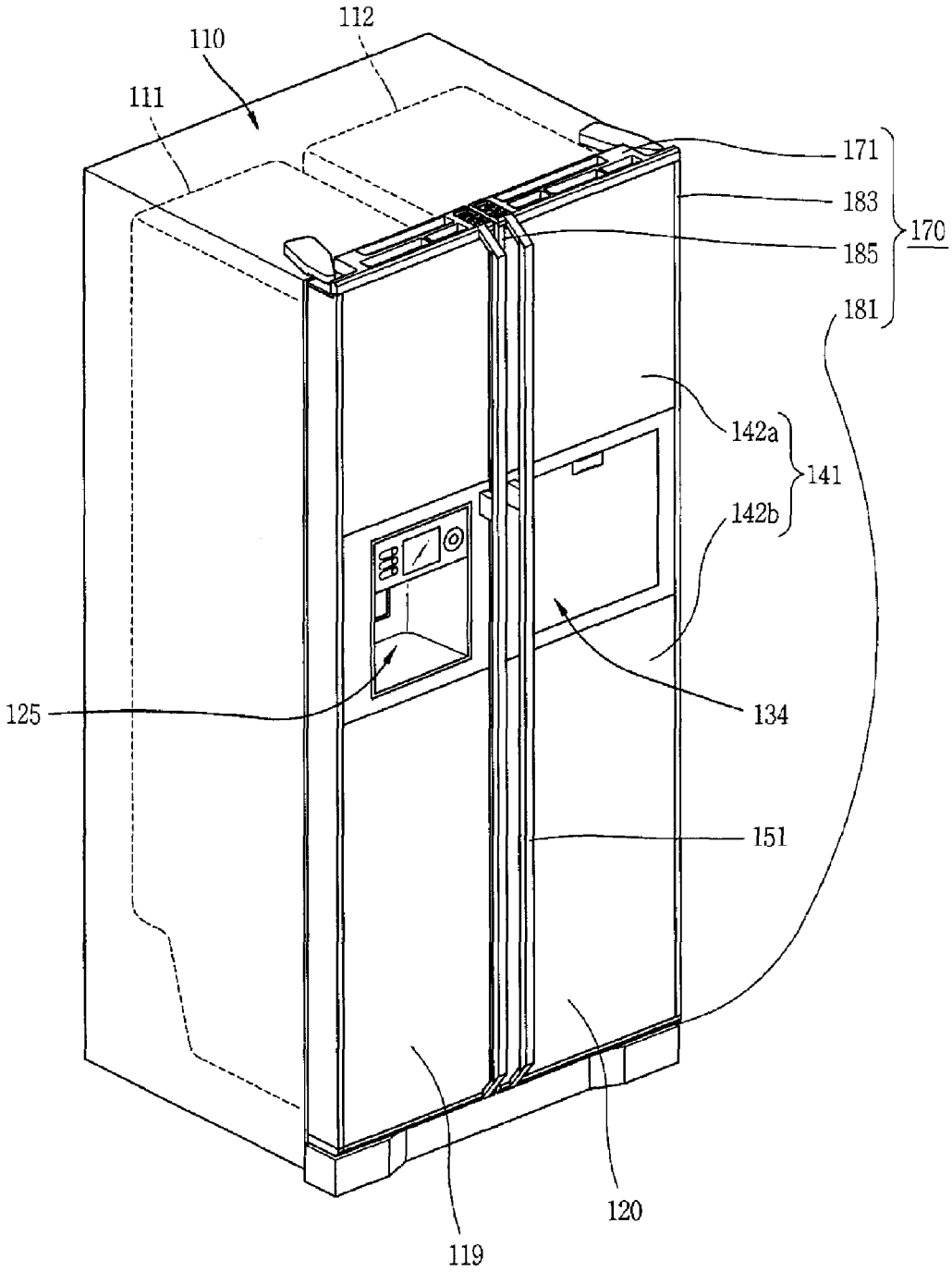
FIG. 1 is a perspective view showing a refrigerator having a door assembly in accordance with one embodiment of the present invention.

As shown in FIG. 1, a refrigerator having a door assembly according to the present invention includes a refrigerator main body 110 having a cooling chamber therein, and door assemblies 119, 120 disposed on a front surface of the refrigerator main body 110 so as to open and close the cooling chamber. Here, the cooling chamber indicates a freezing chamber and a refrigerating chamber, and the refrigerator main body may be provided with one of the freezing chamber and the refrigerating chamber. The refrigerator main body may be provided with the freezing chamber and the refrigerating chamber formed in right and left directions. However, the refrigerator main body may also be implemented as a top freezer type refrigerator or a bottom freezer type refrigerator in which the freezing chamber and the refrigerating chamber are formed in upper and lower directions.

The freezing chamber 111 and the refrigerating chamber 112 are respectively formed in the refrigerator main body 110 in right and left directions. And, the door assemblies 119, 120 are respectively formed on the front surface of the refrigerator main body 110 so as to open and close the freezing chamber 111 and the refrigerating chamber 112. Since the door assembly 119 for opening and closing the freezing chamber 111 has a configuration similar to that of the door assembly 120 for opening and closing the refrigerating chamber 112, the door assembly 120 for opening and closing the refrigerating chamber 112 will be explained as an example, hereafter.

Figure 2:
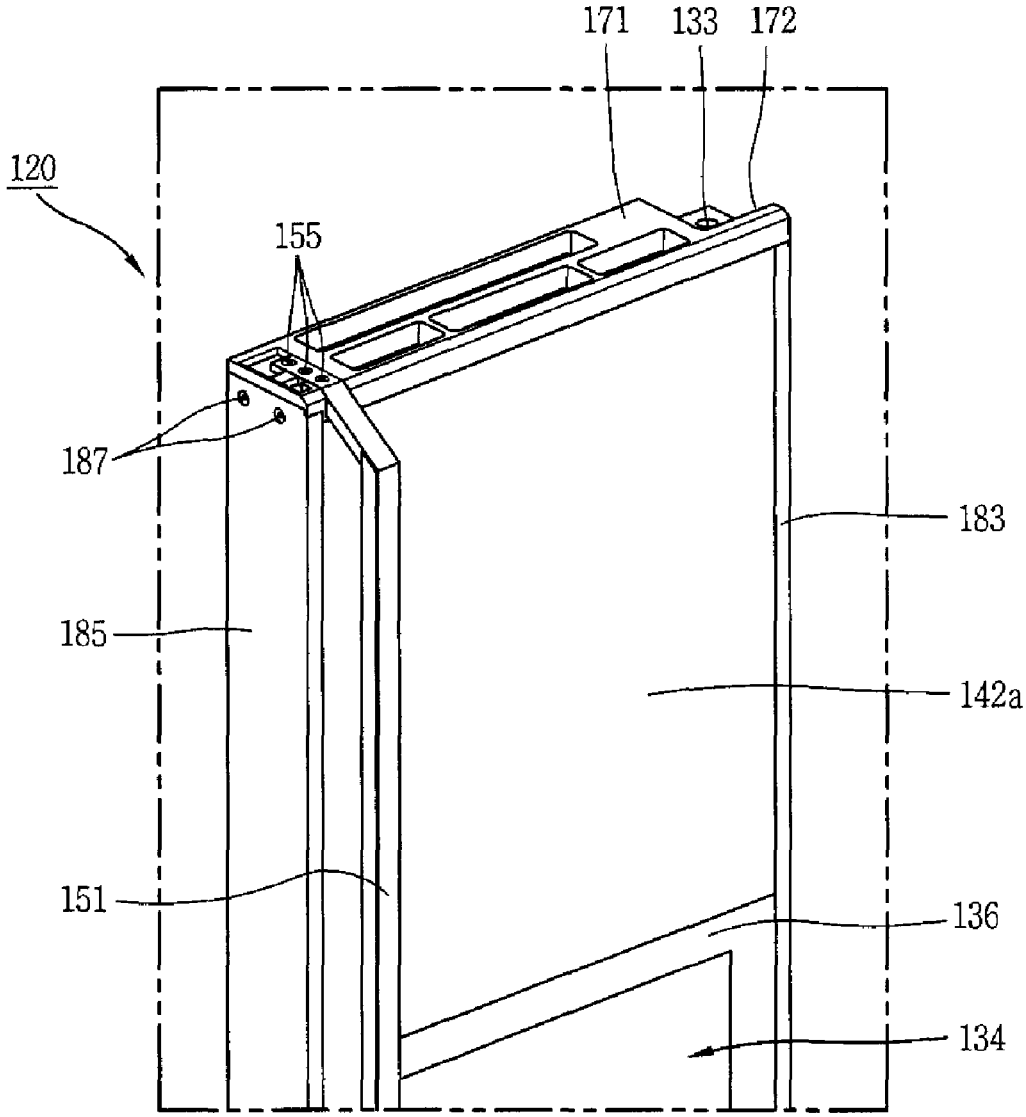
FIG. 2 is an enlarged perspective view showing a handle coupling area in the door assembly of FIG. 1.

The door assembly 120, as shown in FIGS. 1 and 2, includes a door main body 131 rotatably coupled to the front surface of the refrigerator main body 110, a panel 141 disposed on the front surface of the door main body 131, a handle 151 having at least one end coupled to an upper end or a lower end of the door main body 131, and covers 171, 181 respectively provided with a handle receiving portion 175 in which an upper end or a lower end of the handle 151 is received and coupled to the upper end or the lower end of the door main body 131 so as to support the panel 141.

A home bar 134 is formed at the front surface of the door main body 131 so as to discharge out foods in the refrigerator without opening the door main body 131. And, the door assembly 119 for opening and closing the freezing chamber 111 may be provided with a dispenser 125 for discharging out water and/or ice cubes without opening the freezing chamber 111.

A case 136 of the home bar 134 is coupled to the front surface of the door main body 131 of the door assembly 120 for opening and closing the refrigerating chamber 112. And, a first panel 142*a* and a second panel 142*b* are respectively disposed at an upper side and a lower side of the case 136 of the home bar 134 interposed therebetween. Here, the first panel 142*a* and the second panel 142*b* may be implemented as transparent stiff members (e.g., glass members) having a rectangular plate shape. Here, the door main body 131 may have the front surface on which pictures, letters or the like are printed. Alternately, a sheet on which pictures or letters are printed may be disposed between the door main body 131 and the panels 142*a*, 142*b*.

The first panel 142*a* and the second panel 142*b* have the lower end and the upper end respectively supported by an upper end and a lower end of the case 136 of the home bar 134. Here, the door assembly 119 for opening and closing the freezing chamber 111 may also have a plurality of panels disposed at upper and lower sides of the dispenser 125.

Though it is not concretely shown, the door main body 131 may include an outer case 132*a* forming a front surface and a side surface, an inner case 132*b* disposed in the outer case 132*a* with a filling space for a foaming agent, and an upper cap 132*c* and a lower cap (not shown) respectively disposed at an upper end and a lower end of the outer case 132*a* and the inner case 132*b*.

Meanwhile, the cover 170 includes an upper cover 171 and a lower cover 181 respectively disposed at the upper side and the lower side of the door main body 131. Hereafter, the upper cover 171 and the lower cover 181 are respectively coupled to the handle 151 with configurations similar to each other. Thus, the upper cover 171 will be explained as an example.

The upper cover 171 is disposed at an upper side of the upper cap 132*c* of the door main body 131 and supports an upper end of the first panel 142*a*. The lower cover 181 is disposed at a lower end of the door main body 131 and supports a lower end of the second panel 142*b*.

Figure 3:
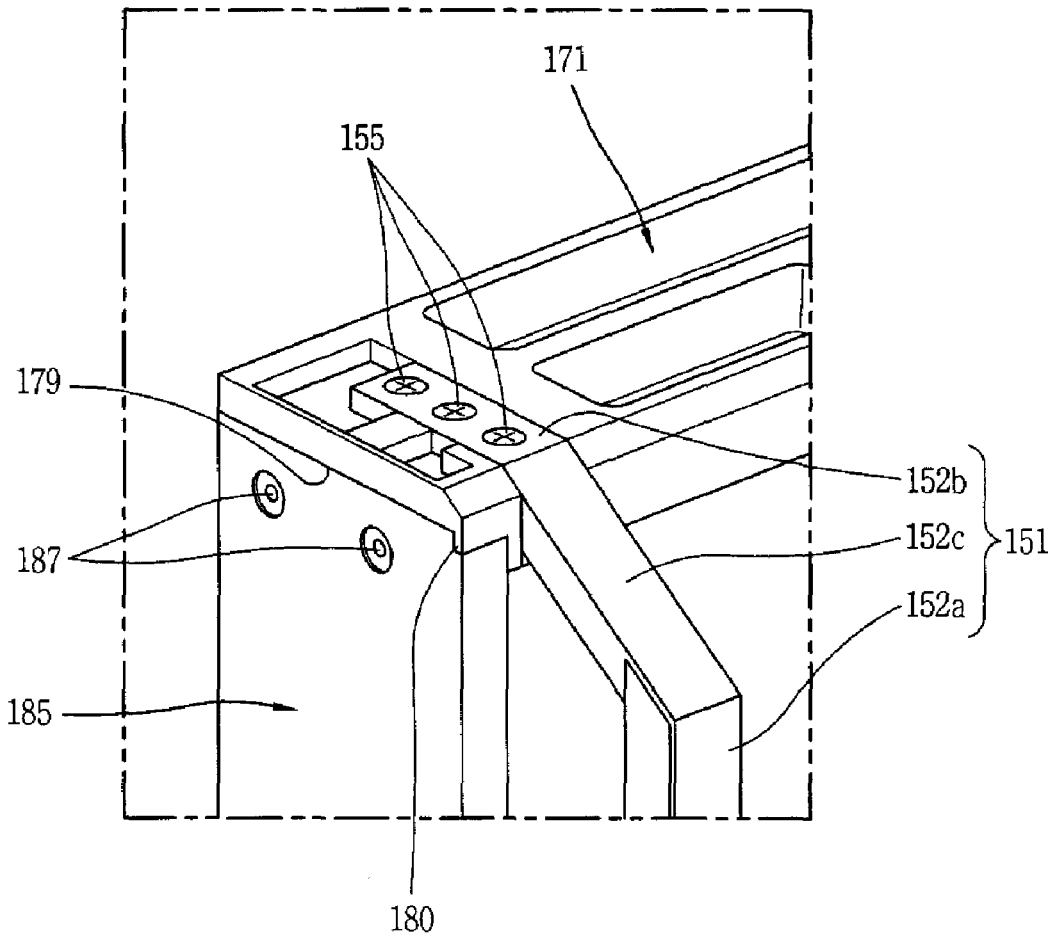
FIG. 3 is an enlarged view showing a handle receiving area in FIG. 2.
Figure 4:
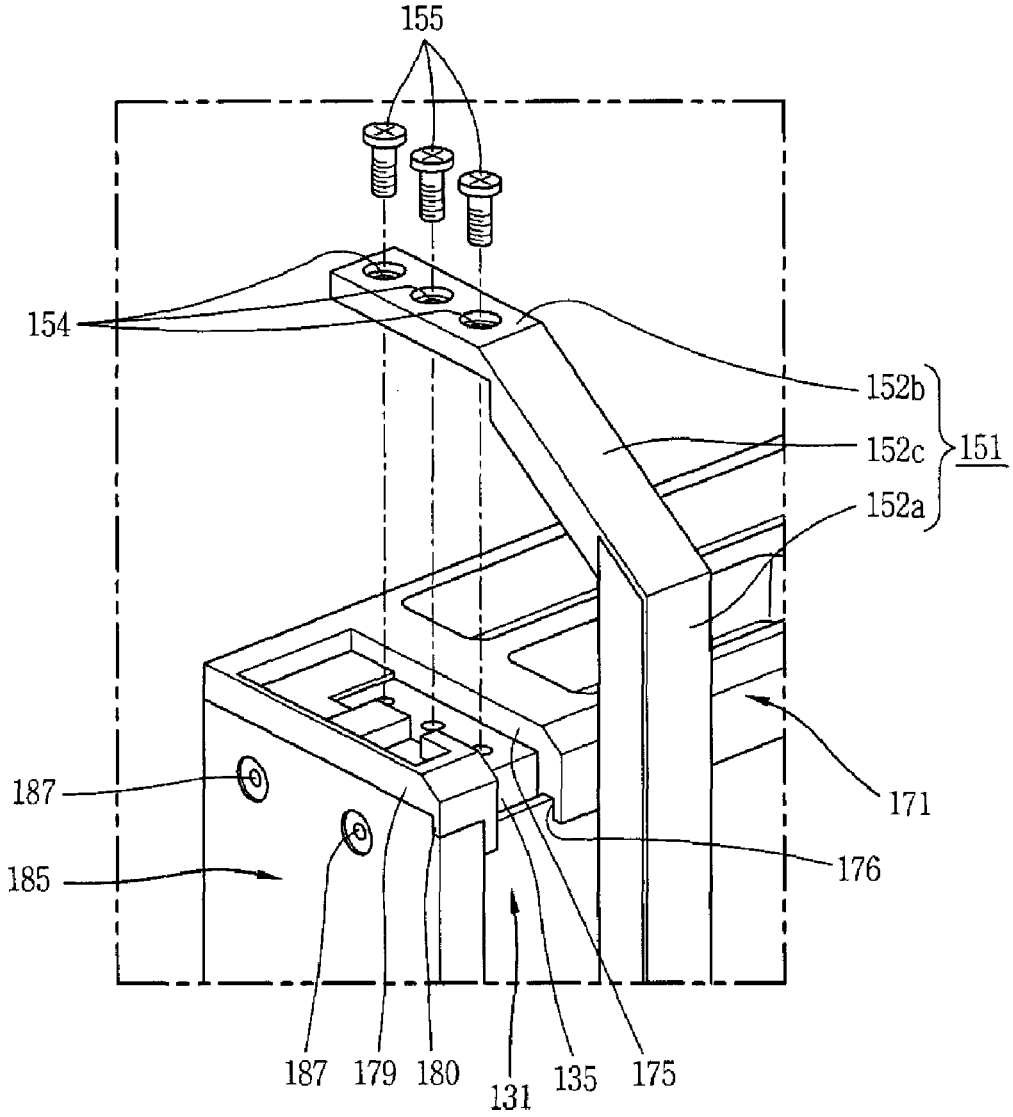
FIG. 4 is a perspective view showing a state that a handle of FIG. 3 is disassembled.
Figure 5:
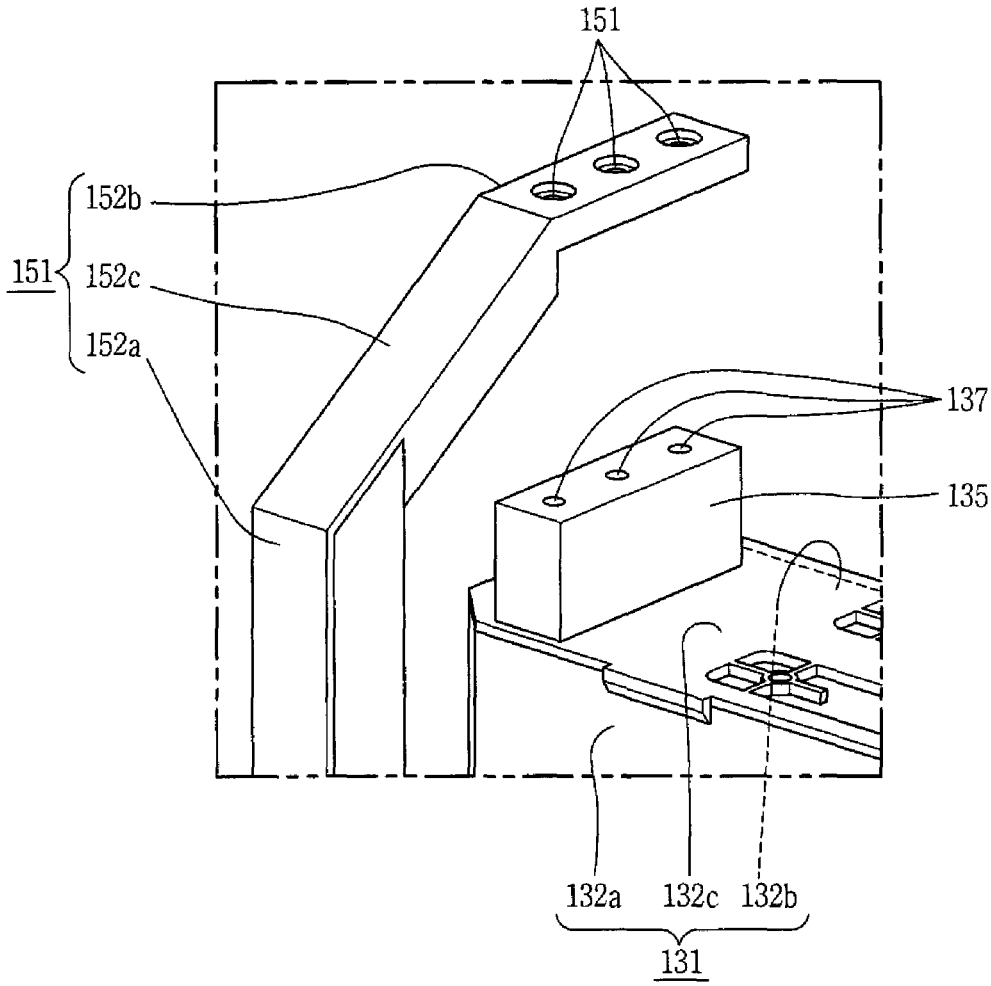
FIG. 5 is an enlarged perspective view partially showing a handle coupling area in FIG. 4.

The handle 151, as shown in FIGS. 3 to 5, includes a rod portion 152*a* disposed on the front surface of the door main body 131 to be perpendicular thereto, horizontal end portions 152*b* coupled to the upper cover 171 and the lower cover 181 and connecting portions 152*c* connecting the horizontal end portions 152*b* to the rod portion 152*b* in an inclined format.

One side of the upper cover 171 is provided with a cut portion 172 cut so as not to be interfered with a hinge portion 133 formed at one side of the upper cap 132*c*. A panel supporting portion 176 is formed at the front surface of the upper cover 171 so as to receive and support the upper end of the first panel 142*a*.

Figure 6:
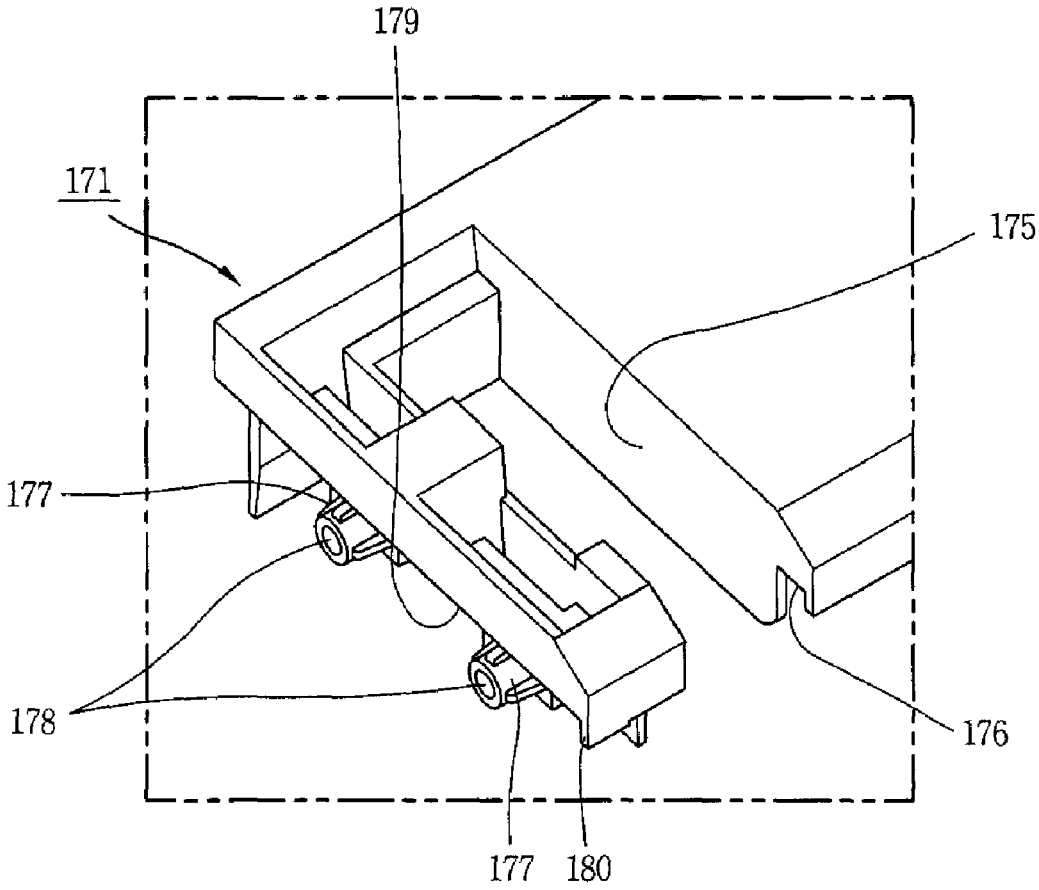
FIG. 6 is an enlarged perspective view showing a main part of an upper cover of FIG. 4.

The handle receiving portion 175 is formed at an opposite side of the hinge portion 133 in a length direction of the upper cover 171, that is, a left end portion area of the upper cover 171 on the drawing, so as to receive the horizontal end portion 152*b* of the handle 151. As shown in FIG. 6, the handle receiving portion 175 is configured to be penetrated in upper and lower directions and to be forwardly open so that the horizontal end portion 152*b* of the handle 151 may be inserted thereinto in upper and lower directions and/or a horizontal direction.

As shown in FIG. 5, a handle coupling portion 135 may be formed in the handle receiving portion 175 so as to be protruded from the upper end of the upper cap 132*c* and coupled to the horizontal end portion 152*b* of the handle 151. Accordingly, stress is concentrated at an area where the handle 151 of the upper cap 132*c* is coupled, thereby preventing an area where the handle is coupled from being damaged.

The handle coupling portion 135 is provided with a plurality of screw coupling portions 137 so that screws 155 having passed through the horizontal end portion 152*b* of the handle 151 can be coupled thereto. The horizontal end portion 152*b* of the handle 151 is provided with a plurality of through holes 154 penetrated for the screws 155.

Figure 7:
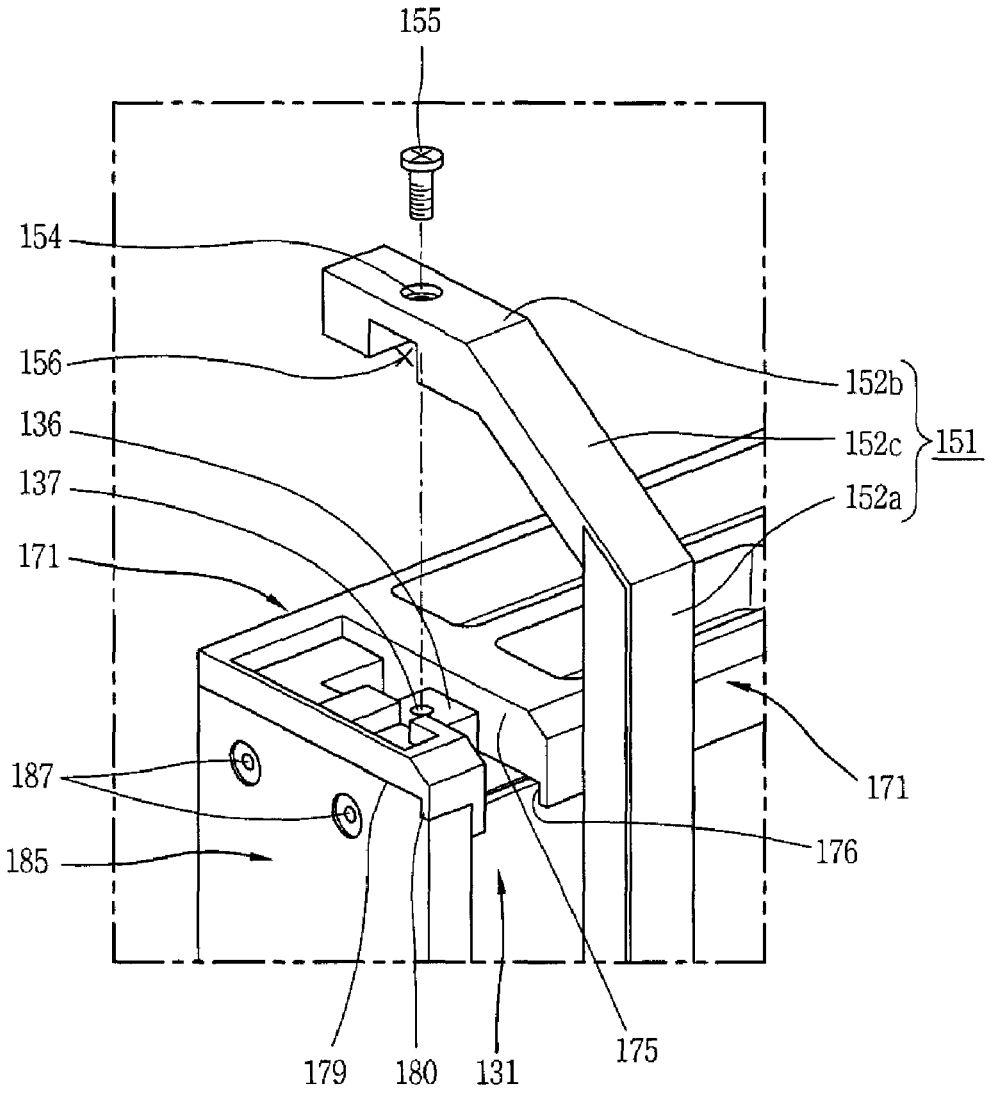
FIG. 7 is a perspective view showing a disassembled state of a handle and a handle coupling portion in accordance with another embodiment of the present invention.

Here, as shown in FIG. 7, a handle coupling portion 136 may be formed to have a length in back and forth directions shorter than thickness of the door main body 131, and an engagement portion 156 may be formed at a lower portion of the horizontal end portion 152*b* of the handle 151 so as to receive the handle coupling portion 136 therein. Accordingly, the hand coupling portion 136 and the handle 151 can be engaged with each other in a state that they are restrained from moving back and forth. Accordingly, strength affected to the screws 155 by which the horizontal end portion 152*b* and the handle coupling portion 135 are coupled to each other at a time of opening and closing the door main body 131 is distributed by the engagement portion 156, thereby reducing the number of screws 155.

The horizontal end portion 152*b* of the handle 151 and the handle coupling portion 135 may be respectively provided with a single through hole 154 and a single screw coupling portion 137. Here, since the handle coupling portion 136 and the engagement portion 156 are engaged with each other so as not to be moved back and forth, the handle 151 is coupled in upper and lower directions on the drawing. Accordingly, the engagement portion 136 may be formed one end of the upper end and the lower end of the handle 151. Here, the other end of the handle 151 may be configured to be coupled to the front surface of the door main body 131. Alternately, as aforementioned with reference to FIGS. 1 to 6, the other end of the handle 151 may be configured to insert the horizontal end portion 152*b* of the handle 151 in back and forth directions.

Meanwhile, at least one of both side surface portions of the door main body 131 may be coupled with a side cover. In this embodiment, a first side cover 183 and a second side cover 185 are respectively coupled to both side surface portions of the door main body 131.

Here, the first side cover 183 is coupled to a side surface portion close to the hinge portion 133 of the door main body 131, and the second side cover 185 is coupled to a side surface portion close to the handle 151 of the door main body 131.

The upper cover 171 may have a length enough to be protruded toward right and left sides of the door main body 131. Preferably, the protruded length of the upper cover 171 is long enough to dispose external surfaces of the first side cover 183 and the second side cover 185 and both end portion surfaces of the upper cover 171 on the same line.

A flat surface 179 may be formed at the lower portion of the end portion of the handle receiving portion 175 of the upper cover 171 so that the upper end of the second side cover 185 can come in planar contact therewith. Accordingly, the second side cover 185 can be disassembled without disassembling the upper cover 171 from the door main body 131.

A stopper 180 may be formed at one side of the upper cover 171 so as to prevent the second side cover 185 from forwardly moving. Here, an upper portion area of the second side cover 185 may be cut so as for the stopper 180 not to be protruded.

At least one boss 177 may be formed at the lower portion of the upper cover 171 to be protruded toward the second side cover 185. In this embodiment, one pair of bosses 177 is formed. The bosses 177 may be respectively provided with female screw portions 178. Corresponding to this, screw holes 187 are formed at the upper area of the second side cover 185 in penetrated shapes allowing the screws coupled to the female screw portions 178 to pass therethrough.

By such configuration, when coupling the first panel 142*a* and the second panel 142*b* to the front surface of the door main body 131, the first side cover 183 is coupled to a right edge of the door main body 131, first. The first panel 142*a* and the second panel 142*b* are coupled to the front surface of the door main body 131 to be supported by the case 136 of the home bar 134 and the first side cover 183.

The upper cover 171 and the lower cover 181 are respectively coupled to the upper end and the lower end of the door main body 131, and the second side cover 185 is disposed at a left edge of the door main body 131. And then, the second side cover 185 is integrally coupled to the door main body 131, the upper cover 171 and the lower cover 181 using the screws. The horizontal end portion 152*b* of the handle 151 is received in the handle receiving portion 175, and the horizontal end portion 152*b* of the handle 151 and the handle coupling portion 135 are fixed by tightening the screws 155.

Meanwhile, when it is desired to replace the upper cover 171, the screws coupled to the upper portion of the second side cover 185 are unscrewed and then the upper cover 171 is replaced.

And, when it is desired to replace the first panel 142*a* and/or the second panel 142*b*, the second side cover 185 is disassembled and then the first panel 142*a* and/or the second panel 142*b* are replaced. That is, when the second side cover 185 is disassembled from the door main body 131, the first panel 142*a* and/or the second panel 142*b* are in a state that they can be slidably discharged out and received in a left direction on the drawing. Thus, the first panel 142*a* and/or the second panel 142*b* can be replaced without disassembling the handle 151, the upper cover 171 or the lower cover 181, accordingly, it is capable of rapidly and easily performing the replacing operation.

So far, a specific embodiment of the present invention is illustrated and explained. However, as the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A door assembly comprising:

a door main body having an outer case, an inner case, an upper surface and a lower surface;

a panel disposed on a front surface of the door main body;

a handle having at least one end coupled to the upper surface or the lower surface of the door main body;

a cover provided with a handle receiving portion allowing an upper end or a lower end of the handle to be received therein;

a side cover coupled to at least one side surface portion of the door main body so as to be able to be disassembled in right and left directions without being restrained by the cover; and a handle coupling portion extending through the handle receiving portion of the cover, and protruding from the upper surface of the door main body and being entirely above the upper surface of the door main body or protruding from the lower surface of the door main body and being entirely below the lower surface of the door main body, wherein the cover comprises an upper cover disposed at the upper surface the door main body and a lower cover coupled to the lower surface of the door main body, wherein the handle is attached to the handle coupling portion, and wherein the panel is supported by the upper cover, the lower cover and the side cover.

2. The door assembly of claim 1, wherein the handle receiving portion is formed at the lower cover.

3. The door assembly of claim 1, wherein the handle and the handle coupling portion are configured to allow the handle to be inserted from a front side of the door main body.

4. The door assembly of claim 1, wherein the handle coupling portion is provided with female screw portions, and the handle is provided with a through hole.

5. The door assembly of claim 1, wherein the handle and the handle coupling portion are engaged with each other so as not to be moved back and forth.

6. The door assembly of claim 5, wherein the handle is provided with an engagement portion in a concave shape so that the handle coupling portion can be inserted thereinto.

7. The door assembly of claim 5, wherein the handle and the handle coupling portion are configured to be coupled to each other by screws.

8. The door assembly of claim 1, wherein at least one of the upper cover and the lower cover is provided with a flat surface to come in planar-contact with an upper end or a lower end of the side cover.

9. The door assembly of claim 1, wherein the cover is provided with a boss disposed at a rear surface of the side cover.

10. The door assembly of claim 9, wherein the side cover is provided with a through hole through which a coupling member coupled to the boss can pass therethrough.

11. The door assembly of claim 1, wherein a surface of the side cover is configured to be disposed on the same plane with an end portion of the cover.

12. The door assembly of claim 1, wherein the cover is provided with a stopper for preventing the side cover from forwardly moving.

13. A refrigerator having a door assembly, the refrigerator comprising:

a refrigerator main body having a cooling chamber therein; and the door assembly of claim 1 which is coupled to the refrigerator main body so as to open and close the cooling chamber.

14. The door assembly of claim 1, wherein the panel is a glass member.

* * * * *